United States Patent [19]

Echterhoff et al.

[11] 4,086,143

[45] Apr. 25, 1978

[54] COKING METHOD AND ARRANGEMENT

[75] Inventors: Heinrich Echterhoff, Essen; Wolfgang Simonis, Gladbeck; Wolfgang Rohde; Kurt-Gunther Beck, both of Essen, all of Germany

[73] Assignee: Bergwerksverband GmbH, Essen, Germany

[21] Appl. No.: 707,874

[22] Filed: Jul. 22, 1976

Related U.S. Application Data

[63] Continuation-in-part of Ser. No. 181,886, Sep. 20, 1971, abandoned, which is a continuation-in-part of Ser. No. 851,700, Aug. 20, 1969, abandoned.

[30] Foreign Application Priority Data

Aug. 24, 1968 Germany ..... 1796063

[51] Int. Cl.[2] ..... C10B 47/00

[52] U.S. Cl. ..... 201/41; 201/44

[58] Field of Search ..... 201/1, 41, 44; 202/151

[56] References Cited

U.S. PATENT DOCUMENTS

| | | | |
|---|---|---|---|
| 1,458,964 | 6/1923 | Baille-Barrelle | 201/41 |
| 1,698,240 | 1/1929 | Puening | 201/10 |
| 3,556,947 | 1/1971 | Kumper | 201/1 |
| 3,607,660 | 9/1971 | Kumper | 201/1 |
| 3,875,016 | 4/1975 | Schmidt-Balve et al. | 201/41 X |

FOREIGN PATENT DOCUMENTS

| | | | |
|---|---|---|---|
| 2,017,021 | 8/1969 | France | 201/1 |

*Primary Examiner*—Joseph Scovronek
*Assistant Examiner*—Arnold Turk
*Attorney, Agent, or Firm*—Michael J. Striker

[57] ABSTRACT

In a coking process wherein coal is subjected to coking in chamber furnaces by means of combustion of a fuel gas in the heat flues of the furnace and transfer of the generated heat through the walls of the furnace, the heat supply is effected, during the entire course of the coking operation, according to a preestablished programmed control scheme related to a uniform or mean rate of heat supply, the supply of heat being at a maximum at the commencement of the coking operation and being gradually reduced during the continuing coking operation.

13 Claims, 1 Drawing Figure

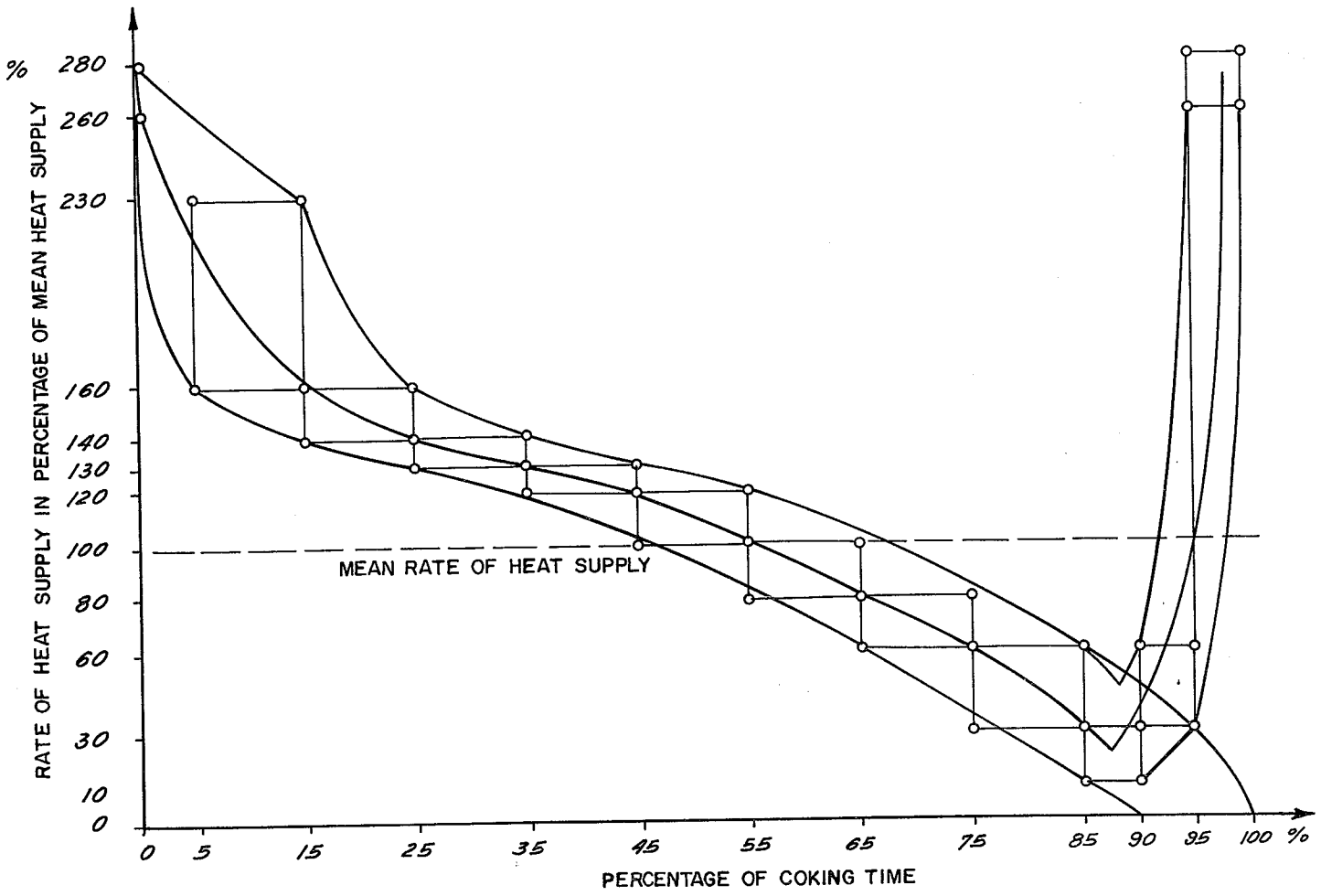
RATE OF HEAT SUPPLY IN PERCENTAGE OF MEAN HEAT SUPPLY
%
280
260
230
160
140
130
120
100
80
60
30
10
0
MEAN RATE OF HEAT SUPPLY
PERCENTAGE OF COKING TIME
0
5
15
25
35
45
55
65
75
85
90
95
100
%

COKING METHOD AND ARRANGEMENT

CROSS-REFERENCES TO RELATED APPLICATIONS

The present application is a continuation-in-part of application Ser. No. 181,886, filed Sept. 20, 1971, now abandoned, which application in turn was a continuation-in-part of application Ser. No. 851,700 filed by the same inventors on Aug. 20, 1969 in respect to "COKING METHOD AND ARRANGEMENT", now abandoned.

BACKGROUND OF THE INVENTION

The invention relates to a process for operating coke ovens. The coke production generally takes place in regenerative horizontal chamber furnaces which are heated indirectly through heating flues with rich or lean gases. The heat generated by the combustion is transmitted through the walls of the individual chambers into the coal. The coking of the coal in the chambers of the furnace is complete as soon as the formed coke has a content of volatile components of about below 1.0%. The operator recognizes the completion of the coking time, for instance, by the changed flame color of the discharge gases.

It has been proposed to decrease the heat supply substantially towards the end of the coking time, and it is known that this can be done without any material prolongation of the coking time. The completion of the charge is then effected only by the exothermal characteristics of the coking reaction. However, normally, the entire coking process, from beginning to end, is carried out under a uniform heat supply.

It is therefore an object of the present invention to provide for variations of the heat supply which will permit a reduction of the conventional coking time or of the total heat supplied and increase of the yield of the furnace chambers.

SUMMARY OF THE INVENTION

These objects are accomplished by a process wherein the coking is effected by combustion of a fuel gas in the heat flues of the furnace and transfer of the generated heat through the walls of the furnace and wherein the operation is carried out in accord with a preset schedule expressed in percentages of the heat requirements of the charge at a uniform or mean rate of heat supply.

The novel features which are considered as characteristic for the invention are set forth in the appended claims. The invention itself, however, both as to its constructive and operative features, will be best understood from the following description of specific embodiments when read in connection with the accompanying drawing.

BRIEF DESCRIPTION OF THE DRAWING

The drawing is a graph which shows the relationship of the coking time to heat supply. On the abscissa the coking time is expressed in percentage of the total time. The ordinate indicates percentages of the heat supply corresponding to the mean heat supply required during a pre-established coking time and indicated by the straight horizontal line at 100%. The band formed by the top and bottom curves shows the optimum rate of supply of heat, based on a specific predetermined total coking time; the right hand side of the graph shows two alternatives.

DESCRIPTION OF THE PREFERRED EMBODIMENTS

If at the commencement of the coking, a substantially higher rate of supply of heat is effected than conventionally employed, no heat is lost thereby in spite of such higher initial rate of supply of heat. This concept results in substantial advantages insofar as the heat economy is concerned, because according to the invention the rate of supply of heat during the entire coking process can be continuously adapted to the requirement of the charges by a programmed pre-arranged control scheme. By rate of supply of heat as used herein is meant the rate at which heat is taken up by the coal without any heat being supplied which is unnecessary for the proceeding coking operation.

In practice, the rate of supply of heat can be adjusted by controlling the gas and air supply to the heat flues. This can be done by providing individual heat flues for the ovens and measuring the temperature of for instance the runner bricks of the ovens.

The coking can be effected at the starting period with a considerably higher rate of supply of heat than was conventional heretofore and this rate of supply of heat can then be gradually reduced in the course of the coking operation to reach a minimum value, in general zero or nearly zero, at the end of the coking operation.

In addition, it has been found that it is preferable to increase the rate of supply of heat, beyond the heat requirement of the charge, towards the end of the operation after the rate of supply of heat has gradually been reduced. Accordingly, it is preferred to increase rate of supply of heat towards the end of the coking operation for instance, about 1 to 2 hours prior to the completion of the coking, and to effect such increase beyond the heat capacity of the charge and up to a rate which corresponds about to that furnished in the beginning of the coking operation. In this manner the individual coke oven chambers can be properly prepared for the coking of the subsequent charge insofar as the heat balance of the operation is involved.

In order to obtain the best results from the prearranged programmed control scheme of heating the coking ovens, it is advisable to depart from the conventional charging and compressing sequence of the chambers of a coke oven battery, which is 1; 6; 11; 16; etc., and instead to follow a sequence such as 1; 2; 3; etc., that is a continuous sequence. This will cause neighbouring charges to be in substantially the same coking condition, and the heating of contiguous ovens can thus be carried out without any material loss of heating by radiation. The interval between charging adjacent coke ovens (or groups of coke ovens) is preferably below 30 minutes and preferably 6 to 16 minutes.

The ovens are in general preferably in groups (e.g. of 5 to 8 ovens), all ovens in one group being charged (i.e. the coking operation started) at substantially the same time (i.e. as soon as possible one after the other). There can be a thermally insulating wall separating the groups from each other and their respective heat flues or generators from each other, thus reducing the heat loss between groups out of phase with each other.

The invention will be further described, by way of example, with reference to the accompanying drawing, which is a graph showing the relationship of the coking time to rate of supply of heat. On the abscissa the coking time is expressed as a percentage of the total time (which total time is between 10 and just above 26 hours). On the ordinate, the rate of supply of heat is expressed as a percentage of the mean rate of supply of heat during the total coking time; 100% indicates the mean rate of supply of heat. The areas under the respective curves represent the total heat supplied. The rate of supply of heat in any one known coking process depends on a number of factors, particularly upon the coking quality of the coal, but in one known process, chosen for comparison with a process in accordance with the invention, the rates of supply of heat (uniform for the whole coking operation) for different coking times were:

| Total Coking Time hrs. | Uniform rate of supply of heat kcal/m².hr |
|---|---|
| 26 | 3200 |
| 24 | 3600 |
| 22 | 4200 |
| 20 | 4750 |
| 18 | 5450 |
| 16 | 6400 |
| 14 | 7600 |
| 12 | 9200 |
| 10 | 11200 |

If the total coking time is 16 hours, a constant or uniform (mean) rate of supply of heat of 6400 kcal/m².hr is required.

A rate of supply of 160% accordingly means that a coking coal at a mean rate of supply of heat of about 5000 kcal/m².hr requires, according to the invention, about 8000 kcal/m².hr, as against a heretofore constant rate of supply of heat of 5000 kcal/m².hr.

It can be seen that the rate of supply of heat at the beginning of coking is considerably higher than the conventional 3000–6000 kcal/m².hr and that the rate of supply of heat sinks to zero or nearly to zero after passing through the mean value.

More specifically, the rate of supply of heat can be arranged in accordance with the invention in relation to the total coking time as appears from the following schedule. Departures of the value upwards or downwards, however, do not imply any departure from the concept of the invention.

| Coking time (%) | Rate of supply of heat (%) |
|---|---|
| 0 to 5 | +280 to +260 |
| 5 to 15 | +230 to +160 |
| 15 to 25 | +160 to +140 |
| 25 to 35 | +140 to +130 |
| 35 to 45 | +130 to +120 |
| 45 to 55 | +120 to +100 |
| 55 to 65 | +100 to + 80 |
| 65 to 75 | + 80 to + 60 |
| 75 to 85 | + 60 to + 30 |
| 85 to 90 | + 30 to + 10 |
| 90 to 95 | + 10 to 0 |
| 95 to 100 | 0 |

A marked increase in the rate of supply of heat can be effected towards the end of the coking time. The heat may then be supplied to the chambers at about the same rate as the start of the coking operation. Thus, the expulsion of the charge of the introduction of fresh coal takes place while a high rate of supply of heat is available. According, when the new coking cycle starts, very little time is necessary for bringing the coking coal to the required high temperature. It has been found that the consequent increase of the heat radiation from the oven chamber during the expulsion and introduction of the charges is of no moment in the total heat balance of the coking process.

The process may, for instance, be carried out such that, starting at a point where 85% of the coking time has elapsed, the rate of supply of heat is as follows:

| Coking time (%) | Rate of supply of heat (%) |
|---|---|
| 85 to 90 | +30 to + 10 |
| 90 to 95 | +10 to + 60 |
| 95 to 100 | +60 to +260 or in an alternative +60 to +280 |

A well known constant rate of supply of heat of, for instance, 500 kcal/m².hr results in completion of the coking charge at a heat consumption which is about 15% higher than with the process of the invention. A still higher uniform rate of supply of heat of 7000 kcal/m².hr effected from the beginning to the end of the coking time would require a heat supply about 25% higher than with the process of the invention.

The following examples will further illustrate the invention.

EXAMPLE 1

A coke oven chamber was used which had a mean width of 450 mm and runner bricks of silica of a thickness of 100 mm (thermal conductivity = 1.6 kcal/m².hr.° C) forming a thermally insulating wall. In this chamber coal with a content of 25% of volatile components was coked in a period of 15 hours. The rate of supply of heat was maintained relative to the elapsed heating time according to the following schedule:

| Coking time hours | Rate of supply of heat kcal/m².hr |
|---|---|
| 0 | 14800 |
| 1 | 11130 |
| 2 | 8960 |
| 3 | 7950 |
| 4 | 7310 |
| 5 | 6890 |
| 6 | 6630 |
| 7 | 6150 |
| 8 | 5565 |
| 9 | 4875 |
| 10 | 4240 |
| 11 | 3445 |
| 12 | 2385 |
| 13 | 1325 |
| 14 | 0 |

If the coking of the same coal was effected in the same coke oven chamber with a rate of supply of heat of 5300 kcal/m².hr, which rate of supply was maintained constant throughout the operation, a coking time of 18 hours would be necessary for completion of the coking of the charge. The total amount of heat required was accordingly 4% higher.

If the same coal was subjected to coking in the same coke oven chamber supplying heat at a uniform rate of 6500 kcal/m².hr, the coking time required was 16 hours until the charge was completely coked. The total heat requirement in this case was accordingly about 15% higher than the heat supply in the case of the process of the invention.

EXAMPLE 2

A coke oven chamber was used which had a mean width of 400 mm and with runner bricks of silica of a thickness of 100 mm forming a thermally insulating wall. The thermal conductivity of the bricks was 1.6 kcal/m$^2$.hr.C. In this chamber a coal having 25% volatile components was subjected to coking in a period of 12 hours. The rate of supply of heat relative to the elapsed heating time was adjusted according to the following schedule:

| Coking time hours | Rate of supply of heat kcal/m$^2$.hr |
|---|---|
| 0 | 14800 |
| 1 | 10254 |
| 2 | 8246 |
| 3 | 7400 |
| 4 | 6924 |
| 5 | 6501 |
| 6 | 5814 |
| 7 | 4969 |
| 8 | 4229 |
| 9 | 3171 |
| 10 | 1903 |
| 11 | 2960 |

If the coking of the same coal in the same coke oven chamber was effected with a uniform rate of supply of heat of 4900 kcal/m$^2$.hr throughout the operation, the necessary coking time was 19 hours for completion of the coking of the charge. The total requirement of heat was 20% higher than for the process of the invention. If the coking of the same coal in the same kind of coke oven chamber was effected with a uniform rate of supply of heat of 6900 kcal/m$^2$.hr throughout the operation, the coking time required was 15 hours for the completion of the coking of the charge. The total heat requirement accordingly was 20% higher than the heat supply required for the process of the present invention.

Without further analysis, the foregoing will so fully reveal the gist of the present invention that others can by applying current knowledge readily adapt it for various applications without omitting features that from the standpoint of prior art fairly constitute essential characteristics of the generic or specific aspects of this invention, therefore, such adaptations should and are intended to be comprehended within the meaning and range of equivalence of the following claims.

What is claimed as new and desired to be protected by Letters Patent is set forth in the appended claims.

1. In a process for coking coal in a coke oven chamber in which the heat required to carry out the coking operation is generated by combustion of gaseous fuels in flues in the walls of the said coke oven chamber and is supplied to the said coke oven chamber by conduction through the said walls, the improvement wherein the supply of heat to the said coke oven chamber is effected exclusively in accordance with a pre-established schedule expressed in percentages of a pre-established mean heat supply rate that is dependent upon the length of the total period required to complete the said coking process, the said schedule providing for an initial coking period during which heat is supplied at a rate much higher than the said mean heat supply rate followed by a continuous gradual decrease of the rate of heat supply during the remainder of the coking period up to at least a final portion of the coking period.

2. A process as defined in claim 1 in which heat is supplied to the said coke oven chamber at a rate that accords with the following schedule, in which the elapsed intervals of time are listed as percentages of the total coking period in the first column, while in the second column are listed the corresponding rates at which heat is supplied in percentages of the mean heat supply rate:

| Coking time (%) | Rate of supply of heat (%) |
|---|---|
| 0 to 5 | 280 to 260 |
| 5 to 15 | 230 to 160 |
| 15 to 25 | 160 to 140 |
| 25 to 35 | 140 to 130 |
| 35 to 45 | 130 to 120 |
| 45 to 55 | 120 to 100 |
| 55 to 65 | 100 to 80 |
| 65 to 75 | 80 to 60 |
| 75 to 85 | 60 to 30 |
| 85 to 90 | 30 to 10 |
| 90 to 95 | 10 to 0 |
| 95 to 100 | 0. |

3. A process as defined in claim 1 in which the heat is supplied to the said coke oven chamber during said final portion at a rate that accords with the following schedule, in which the elapsed intervals of time are listed as percentages of the total coking period in the first column, while in the second column are listed the corresponding rates at which heat is supplied in percentages of the mean heat supply rate:

| Coking time (%) | Rate of supply of heat (%) |
|---|---|
| 85 to 90 | 30 to 10 |
| 90 to 95 | 10 to 60 |
| 95 to 100 | 60 to 280 |

4. A process as defined in claim 1 in which said decrease of the rate of heat according to said preestablished schedule is effected through said final portion down to a complete shut-off of the heat supply.

5. A process as defined in claim 1 in which the rate of heat supply is again increased according to said preestablished schedule during said final portion until it exceeds the said mean heat supply rate so that when the finished coke is discharged from the coke oven chamber and the chamber is recharged with a fresh charge of coal, a relatively high amount of heat still remains in the walls of the coke oven chamber.

6. A process as defined in claim 5 in which the rate of heat supply during said final portion is increased until it is approximately at the rate of heat supply during the initial coking period.

7. A process as defined in claim 5 in which said final portion extends through 1 to 2 hours before the end of the coking period.

8. A process as claimed in claim 1 and carried out in a coking plant having a series of adjacent coke ovens, the coke ovens being charged in turn, the coke oven being charged being adjacent the coke oven previously charged except at the beginning of the series.

9. A process as claimed in claim 8 wherein the coke ovens are charged in groups and each group charged is adjacent the group previously charged except at the beginning of the series.

10. A process as claimed in claim 9, wherein there are 5 to 8 coke ovens in each group.

11. A process as claimed in claim 9 wherein there is a thermally insulating wall separating the said groups of ovens from each other.

12. A process as claimed in claim 9, wherein the interval between charging adjacent coke ovens or groups of coke ovens is below 30 minutes.

13. A process as claimed in claim 12, wherein the interval between charging adjacent coke ovens or groups of ovens is 6 to 15 minutes.

* * * * *